US010045419B2

(12) United States Patent
Wang et al.

(10) Patent No.: US 10,045,419 B2
(45) Date of Patent: Aug. 7, 2018

(54) COLOR-TEMPERATURE ADJUSTABLE LED LIGHTNING DEVICE AND METHOD FOR ADJUSTING COLOR TEMPERATURE OF LED LIGHTING DEVICE

(71) Applicant: SENGLED CO., LTD., Shanghai (CN)

(72) Inventors: Mingshuai Wang, Shanghai (CN); Zhenfeng Ding, Shanghai (CN); Zhibin Tian, Shanghai (CN); Jinxiang Shen, Shanghai (CN)

(73) Assignee: SENGLED CO., LTD., Shanghai (CN)

( * ) Notice: Subject to any disclaimer, the term of this patent is extended or adjusted under 35 U.S.C. 154(b) by 0 days.

(21) Appl. No.: 15/545,727

(22) PCT Filed: Dec. 12, 2016

(86) PCT No.: PCT/CN2016/109529
§ 371 (c)(1),
(2) Date: Jul. 24, 2017

(87) PCT Pub. No.: WO2017/114146
PCT Pub. Date: Jul. 6, 2017

(65) Prior Publication Data

US 2018/0027626 A1 Jan. 25, 2018

(30) Foreign Application Priority Data

Dec. 29, 2015 (CN) ..... 2015 1 1020001

(51) Int. Cl.
*H05B 33/08* (2006.01)
*H05B 37/02* (2006.01)

(52) U.S. Cl.
CPC ..... *H05B 33/0866* (2013.01); *H05B 33/083* (2013.01); *H05B 33/0815* (2013.01);
(Continued)

(58) Field of Classification Search
CPC ..... H05B 33/0815; H05B 33/0818; H05B 33/0884; H05B 33/0809; H05B 33/0848; H05B 33/0896
(Continued)

(56) References Cited

U.S. PATENT DOCUMENTS

2008/0116818 A1* 5/2008 Shteynberg ..... H05B 33/0815 315/192
2009/0251071 A1* 10/2009 Gater ..... G09G 3/342 315/297
(Continued)

FOREIGN PATENT DOCUMENTS

CN 202065732 12/2011
CN 102752899 A 10/2012
(Continued)

*Primary Examiner* — Douglas W Owens
*Assistant Examiner* — Syed M Kaiser
(74) *Attorney, Agent, or Firm* — Anova Law Group, PLLC

(57) ABSTRACT

A color-temperature adjustable light-emitting diode (LED) lighting device and a method for adjusting the color temperature of an LED lighting device are provided. The color-temperature adjustable LED lighting device includes: a power supply module, a micro-control unit (MCU), an adjustable LED driving power supply having a positive output terminal and a negative output terminal, a cool white LED array, a warm white LED array, a first switch circuit, a second switch circuit, a first current detection circuit, and a second current detection circuit. The power supply module is connected to an input terminal of the MCU and an input terminal of the adjustable LED driving power supply.

10 Claims, 6 Drawing Sheets

(52) U.S. Cl.
CPC ..... *H05B 33/0845* (2013.01); *H05B 33/0872* (2013.01); *H05B 37/0272* (2013.01)

(58) Field of Classification Search
USPC ..... 315/186, 294, 297, 307, 122, 192, 224
See application file for complete search history.

(56) References Cited

U.S. PATENT DOCUMENTS

| | | | | |
|---|---|---|---|---|
| 2012/0081009 | A1* | 4/2012 | Shteynberg ..... | H05B 33/083 315/122 |
| 2014/0191670 | A1* | 7/2014 | Ge ..... | H05B 33/0815 315/186 |
| 2015/0271891 | A1 | 9/2015 | Wu et al. | |

FOREIGN PATENT DOCUMENTS

| | | | |
|---|---|---|---|
| CN | 104582189 | A | 4/2015 |
| CN | 104754828 | A | 7/2015 |
| CN | 105025635 | A | 11/2015 |
| CN | 105491761 | A | 4/2016 |
| CN | 205491361 | U | 8/2016 |

* cited by examiner

COLOR-TEMPERATURE ADJUSTABLE LED LIGHTNING DEVICE AND METHOD FOR ADJUSTING COLOR TEMPERATURE OF LED LIGHTING DEVICE

CROSS-REFERENCES TO RELATED APPLICATIONS

This application is a national phase entry under 35 U.S.C. § 371 of International Application No. PCT/CN2016/109529, filed on Dec. 12, 2016, which claims priority to Chinese Patent Application No. 201511020001.3 filed on Dec. 29, 2015. The above enumerated patent applications are incorporated by reference herein in their entirety.

FIELD OF THE DISCLOSURE

The present disclosure relates to the field of light emitting diode (LED) technologies and, more particularly, relates to a color-temperature adjustable LED lighting device and a method for adjusting the color temperature of an LED lighting device.

BACKGROUND

As the advances in science, technology, and the improvement in quality of life, people have higher and higher standards for lighting using LED lamps. To realize second time energy conservation, people expect to realize brightness adjustment by freely adjusting the brightness of lamps. To create different moods/atmosphere, people are desire to adjust color temperature of LED lamps and personalize light ambient.

It has been found that, by using two dimming power supplies to respectively drive white LED arrays of two color temperatures, i.e., a high color temperature and a low color temperature, and adjusting a ratio of driving current in the two dimming power supplies, color temperature adjustment may be implemented. However, the described conventional method of color temperature adjustment often causes problems. For example, adjustment of brightness often affects adjustment of color temperature. People often do not like the brightness of the lamp to change when adjusting the color temperature of the lamp, or the color temperature of the lamp to undergo substantial shift when adjusting the brightness of the lamp. That is, people often prefer little or no interference between color-temperature adjustment and brightness adjustment.

The disclosed devices and methods are directed to solve one or more problems set forth above and other problems.

BRIEF SUMMARY OF THE DISCLOSURE

An aspect of the present disclosure provides a color-temperature adjustable light-emitting diode (LED) lighting device, comprising: a power supply module, a micro-control unit (MCU), an adjustable LED driving power supply having a positive output terminal and a negative output terminal, a cool white LED array, a warm white LED array, a first switch circuit, a second switch circuit, a first current detection circuit, and a second current detection circuit. The power supply module is connected to an input terminal of the MCU and an input terminal of the adjustable LED driving power supply. A first branch circuit and a second branch circuit are connected in parallel to the positive output terminal of the adjustable LED driving power supply, wherein the cool white LED array, the first switch circuit and the first current detection circuit are connected in series in the first branch circuit, and the warm white LED array, the second switch circuit, and the second current detection circuit are connected in series in the second branch circuit, the negative output terminal of the adjustable LED driving power supply being grounded. The MCU is connected to the first switch circuit, the second switch circuit, a first terminal of the first current detection circuit, a first terminal of the second current detection circuit, and a first terminal of the adjustable LED driving power supply so that the MCU outputs a first pulse width modulation (PWM) signal to the first switch circuit, and output a second PWM signal to the second switch circuit, the second PWM signal and the first PWM signal having opposite phases and being used to control on-times of the warm white LED array and the cool white LED array, respectively.

Optionally, the MCU detects a first current flowing through the cool white LED array through the first current detection circuit during an on-time of the cool white LED array, detects a second current flowing through the warm white LED array through the second current detection circuit during an on-time of the warm white LED array, and determines a first current ratio parameter based on the first current and the second current. Based on a correspondence relationship between a current ratio parameter, obtained in advance, and a color temperature, the MCU determines a target current ratio parameter corresponding to a target color temperature entered by a user. Based on the first current ratio parameter and the target current ration parameter, the MCU adjusts duty cycles of the first PWM signal and the second PWM signal, such that the first current ratio parameter is substantially equal to the target current ratio parameter.

Optionally, the MCU detects a first voltage between two terminals of the first current detection circuit, and obtains the first current based on the first voltage and a resistance of the first current detection circuit; and the MCU detects a second voltage between two terminals of the second current detection circuit, and obtains the second current based on the second voltage and a resistance of the second current detection circuit.

Optionally, the first current ratio parameter is substantially equal to one of: a ratio of the first current to the second current, a ratio of the first current to a sum of the first current and the second current, and a ratio of the second current to the sum of the first current and the second current.

Optionally, when the first current ratio parameter is substantially equal to the ratio of the first current to the second current, and when the first current ratio parameter is greater than the target current ratio parameter, the MCU reduces a duty cycle of the first PWM signal and increase a duty cycle of the second PWM signal; and when the first current ratio parameter is smaller than the target current ratio parameter, the MCU increases the duty cycle of the first PWM signal and decreases the duty cycle of the second PWM signal.

Optionally, a first output terminal of the MCU is connected to the first switch circuit and an input terminal of the inverter; an output terminal of the inverter is connected to the second switch circuit, a second output terminal of the MCU is connected to a first terminal of the first current detection circuit; a third output terminal of the MCU is connected to a first terminal of the second current detection circuit, a second terminal of the first current detection circuit and a second terminal of the second current detection terminal both being grounded; and a fourth output terminal of the MCU is connected to a first input terminal of the adjustable LED driving power supply.

Optionally, the first PWM signal is inverted by the inverter to the second PWM signal such that the second PWM signal and the first PWM signal having opposite phases.

Optionally, the first current detection circuit is a first resistor, and the second current detection circuit is a second resistor, the first switch circuit is a first field effect transistor (FET), and the second switch circuit is a second FET.

Optionally, the first output terminal of the MCU is connected to a gate electrode of the first FET, a source electrode of the first FET is connected to an input terminal of the first current detection circuit, and a drain electrode of the first FET is connected to the cool white LED array; and an output terminal of the inverter is connected to a gate electrode of the second FET, a source electrode of the second FET is connected to an input terminal of the second current detection circuit, a drain electrode of the second FET is connected to the warm white LED array.

Another aspect of the present disclosure provides a method for adjusting a disclosed color temperature of the color-temperature adjustable LED lighting device, including: detecting a first current flowing through the warm white LED array and a second current flowing through the cool white LED array in the color-temperature adjustable LED lighting device; determining a first current ratio parameter based on the first current and the second current; based on a correspondence relationship between a current ratio parameter and a color temperature, determining a target current ratio parameter corresponding to a target color temperature entered by a user; and based on the first current ratio parameter and the target current ratio parameter, adjusting the duty cycles of the first PWM signal and the second PWM signal that are corresponding to on-times of the cool white LED array and the warm white LED array, such that the first current ratio parameter is substantially equal to the target current ratio parameter.

Optionally, the first current ratio parameter is substantially equal to one of: a ratio of the first current to the second current, a ratio of the first current to a sum of the first current and the second current, and a ratio of the second current to the sum of the first current and the second current.

Optionally, when the first current ratio parameter is substantially equal to the ratio of the first current to the second current, and when the first current ratio parameter is greater than the target current ratio parameter, reducing a duty cycle of the first PWM signal and increasing a duty cycle of the second PWM signal; and when the first current ratio parameter is smaller than the target current ratio parameter, increasing the duty cycle of the first PWM signal and decreasing the duty cycle of the second PWM signal.

Optionally, the correspondence relationship between a current ratio parameter and a color temperature is obtained and stored in the color-temperature adjustable LED lighting device before the user enters the target color temperature, the correspondence relationship being formed by measuring correspondence between a current ratio parameter and a color temperature for multiple times.

BRIEF DESCRIPTION OF THE DRAWINGS

The following drawings are merely examples for illustrative purposes according to various disclosed embodiments and are not intended to limit the scope of the present disclosure.

DETAILED DESCRIPTION

Reference will now be made in detail to exemplary embodiments of the invention, which are illustrated in the accompanying drawings. Hereinafter, embodiments consistent with the disclosure will be described with reference to drawings. Wherever possible, the same reference numbers will be used throughout the drawings to refer to the same or like parts. It is apparent that the described embodiments are some but not all of the embodiments of the present invention. Based on the disclosed embodiment, persons of ordinary skill in the art may derive other embodiments consistent with the present disclosure, all of which are within the scope of the present invention.

One aspect of the present disclosure provides a color-temperature adjustable LED lighting device.

Figure 1:
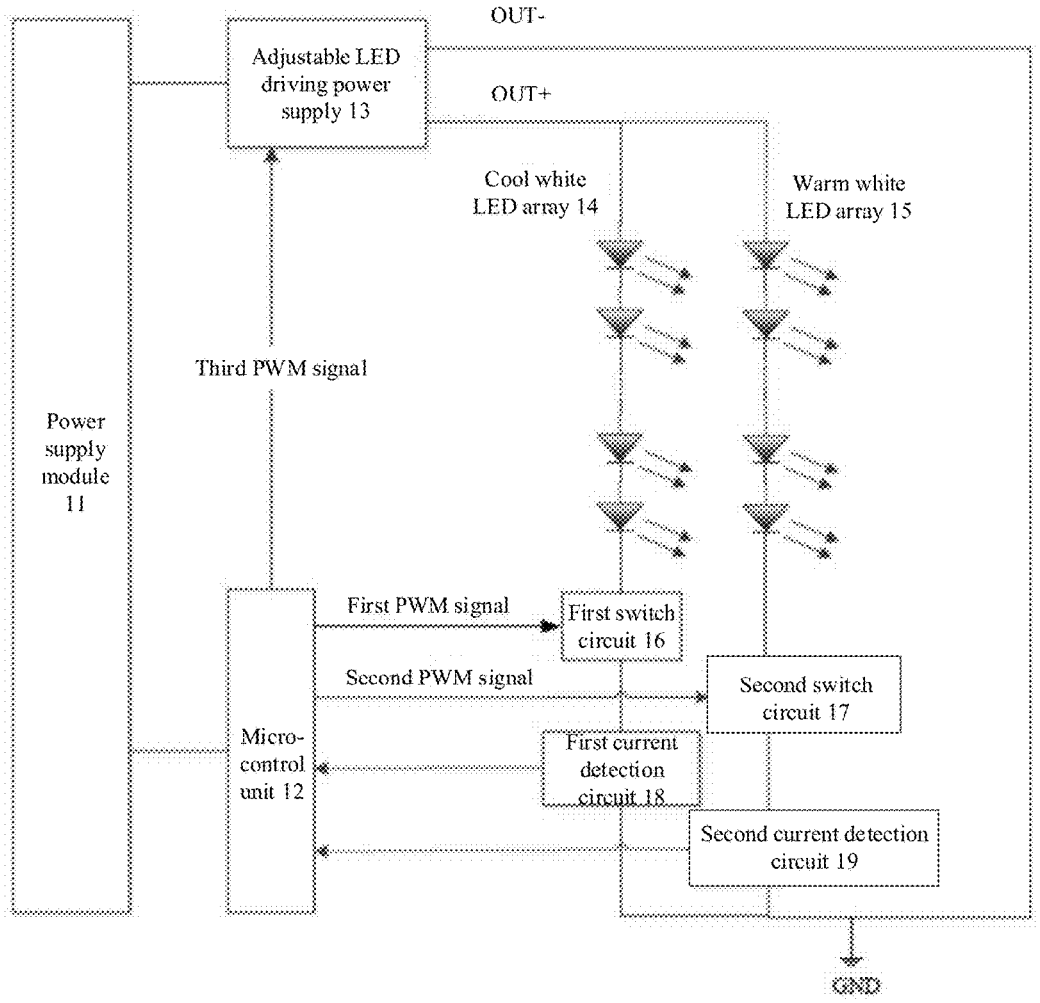
FIG. 1 illustrates a structure of an exemplary color-temperature adjustable LED lighting device consistent with various disclosed embodiments of the present disclosure.

FIG. 1 illustrates a structure of an exemplary color-temperature adjustable LED lighting device. As shown in FIG. 1, the color-temperature adjustable LED lighting device may include a power supply module 11, a micro-control unit (MCU) 12, an adjustable LED driving power supply 13, a cool white LED array 14, a warm white LED array 15, a first switch circuit 16, a second switch circuit 17, a first current detection circuit 18, and a second current detection circuit 19. The disclosed color-temperature adjustable LED lighting device may also be referred to as the disclosed LED lighting device or the LED lighting device in the present disclosure.

The power supply module 11 may be connected to or coupled to an input terminal of the MCU 12 and an input terminal of the adjustable LED power supply 13. The power supply module 11 may provide electric power for the MCU 12 and the adjustable LED power supply 13. In the present disclosure, terms "connected to" and "coupled to" may be interchangeable. One object may be coupled to another object by any suitable types of couplings, e.g., electrical coupling, mechanical coupling, and/or wireless coupling.

The adjustable LED driving power supply 13 may include a positive output terminal OUT+ and a negative output terminal OUT−. A first branch circuit and a second branch circuit may be connected in parallel and connected to the positive output terminal OUT+ of the adjustable LED driving power supply 13. A cool white LED array 14, a first switch circuit 16, and a first current detection circuit 18 may be sequentially connected in series in the first branch circuit. A warm white LED array 15, a second switch circuit 17, and a second current detection circuit 19 may be sequentially connected in series in the second branch circuit. The negative output terminal OUT− of the adjustable LED driving power supply 13 may be grounded.

The MCU 12 may be connected to the first switch circuit 16, the second switch circuit 17, the first terminal of the first current detection circuit 18, the first terminal of the second current detection circuit 19, and the first terminal of the adjustable LED driving power supply 13. In one embodiment, as shown in FIG. 1, the MCU 12 may include at least five output terminals. The first output terminal of the MCU 12 may be connected to the first switch circuit 16. The second output terminal of the MCU 12 may be connected to the first terminal of the first current detection circuit 18. The third output terminal of the MCU 12 may be connected to the first terminal of the second current detection circuit 19. The second terminal of the first current detection circuit 18 and the second terminal of the second current detection circuit 19 may be grounded. The fourth output terminal of the MCU 12 may be connected to the first input terminal of the adjustable LED power supply 13. The fifth output terminal of the MCU 12 may be connected to the second branch circuit 17. Correspondingly, the MCU 12 may output a first pulse width modulation (PWM) signal through the first output terminal, and output a second PWM signal through the fifth output terminal. The second PWM signal and the first PWM signal may have opposite phases. In this configuration, the duty cycle of the first PWM signal and the duty cycle of the second PWM signal may be adjusted separately.

Figure 2:
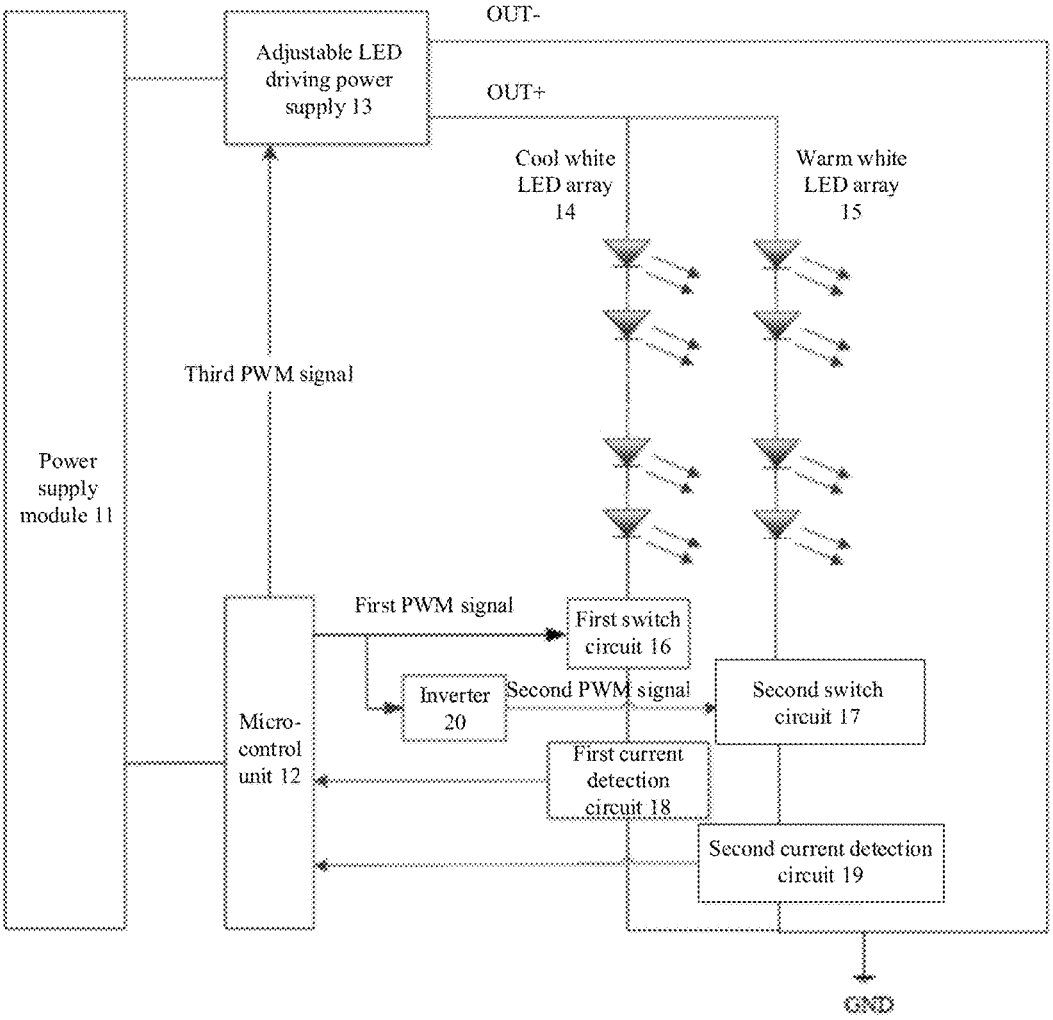
FIG. 2 illustrates a structure of another exemplary color-temperature adjustable LED lighting device consistent with various disclosed embodiments of the present disclosure.

In another embodiment, the disclosed LED lighting device may further include an inverter 20. FIG. 2 illustrates another structure of the disclosed LED lighting device. As shown in FIG. 2, the MCU 12 may include four output terminals. The first output terminal of the MCU 12 may be connected to the first switch circuit 16 and the input terminal of the inverter 20, respectively. The output terminal of the inverter 20 may be connected to the second switch circuit 17. The first switch circuit 16 and the second switch circuit 17 may each have at least three terminals for connection. Three terminals of the first switch circuit 16 may be connected to the first output terminal of the MCU 12, the cool white LED array 14, and the first terminal of the first current detection circuit 18, respectively. Three terminals of the second switch circuit 17 may be connected to the output terminal of the inverter 20, the warm white LED array 15, and the first terminal of the second current detection circuit 19, respectively. The second output terminal of the MCU 12 may be connected to the first terminal of the first current detection circuit 18. The third output terminal of the MCU 12 may be connected to the first terminal of the second current detection circuit 19. The second terminal of the first current detection circuit 18 and the second terminal of the second current detection terminal 19 may both be grounded. The fourth output terminal of the MCU 12 may be connected to the first input terminal of the adjustable LED driving power supply 13. Correspondingly, the MCU 12 may output a first PWM signal through the first output terminal. The first PWM signal may be inverted by the inverter 20 to a second PWM signal. The second PWM signal and the first PWM signal may have opposite phases. In this configuration, when the duty cycle of the first PWM signal changes, the duty cycle of the second PWM signal may change correspondingly.

The first PWM signal may be used to control the on and off states of the first switch circuit 16, so as to further control the on and off states of the cool white LED array 14. The second PWM signal may be used to control the on and off states of the second switch circuit 17, so as to further control the on and off states of the warm white LED array 15. For example, when the first PWM signal is a high-level signal, the second PWM signal may be a low-level signal. Accordingly, the cool white LED array 14 may be turned on and the warm white LED array 15 may be turned off. When the first PWM signal is a low-level signal, the second PWM signal may be a high-level signal. Accordingly, the cool white LED array 14 may be turned off and the warm white LED array 15 may be turned on. The MCU 12 may adjust the ratio of the on-time of the cool white LED array 14 to the on-time of the warm white LED array 15 in a unit of time, through controlling the duty cycles of the first PWM signal and the second PWM signal. By taking advantage the delay of human eyes, variation of color temperature of the disclosed LED lighting device may be implemented. The duty cycle may be a ratio of the time of high-level voltage to the time of low-level voltage, for a signal. The fourth output terminal of the MCU 12 may output a third PWM signal to control the brightness of the cool white LED array 14 and the brightness of the warm white LED array 15. Specifically, when the third PWM signal varies, the output current of the adjustable LED driving power supply 13 may vary accordingly. That is, the current flowing through the cool white LED array 14 and the warm white LED array 15 may vary, so that the brightness of the cool white LED array 14 and the brightness of the warm white LED array 15 may vary accordingly.

The MCU 12 may detect the first current flowing through the cool white LED array 14 through the first current detection circuit 18, and detect the second current flowing through the warm white LED array 15 through the second current detection circuit 19. The MCU 12 may further determine a first current ratio parameter based on the first current and the second current. Also, based on a correspondence relationship between a current ratio parameter, obtained in advance, and a color temperature, the MCU 12 may determine a target current ratio parameter corresponding to the target color temperature entered by a user. Further, based on the first current ratio parameter and the target current ration parameter, the MCU 12 may adjust the duty cycles of the first PWM signal and the second PWM signal, such that the first current ratio parameter can be substantially equal to the target current ratio parameter.

In one embodiment, a current detector may be included in each one of the first current detection circuit 18 and the second current detection circuit 19. A current detector is a detection device that is capable of detecting information of the current being detected. A current detector is also capable of, according to certain laws, converting detected information to an electric signal or other desired forms that meet a desired requirement. As such, information may be desirably transmitted, processed, stored, displayed, recorded, and controlled. In one embodiment, the current detector may send detected current to MCU 12, so that MCU 12 may obtain the values of the first current and the second current.

In some embodiments, the first current detection circuit 18 may be a first resistor, and the second current detection circuit 19 may be a second resistor. In various other embodiments, the first current detection circuit 18 and the second current detection circuit 19 may also each include more than one resistor and/or other related parts. MCU 12 may detect a first voltage between the two terminals of the first current detection circuit 18, and obtain the first current based on the first voltage and the resistance of the first current detection circuit 18. MCU 12 may also detect a second voltage between the two terminals of the second current detection circuit 19, and obtain the second current based on the second voltage and the resistance of the second current detection circuit 18.

In some embodiments, the first current ratio parameter may be substantially equal to a ratio of the first current to the second current. In some other embodiments, the first current ratio parameter may be a ratio of the first current to the total current, where the total current may be substantially equal to the sum of the first current and the second current. In some other embodiments, the first current ratio parameter may be a ratio of the second current to the total current. The first current may be the real-time current flowing through the cool white array 14 and detected by the first current detection circuit 18. The second current may be the real-time current flowing through the warm white array 15 and detected by the second current detection circuit 19.

Figure 3:
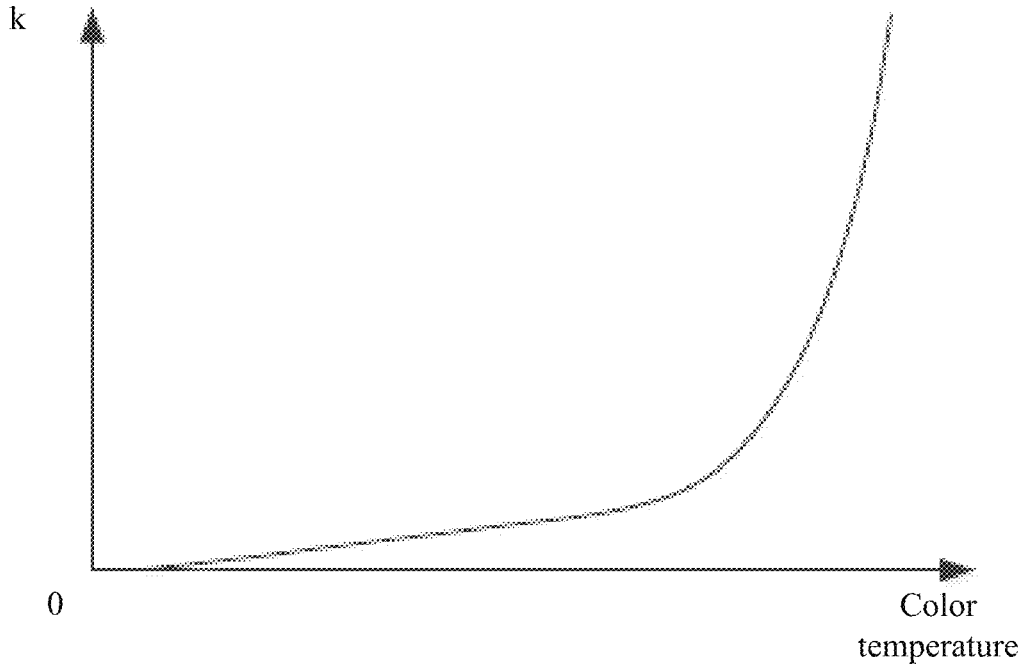
FIG. 3 illustrates a ratio of current varying as a function of color temperature consistent with various disclosed embodiments of the present disclosure.

The correspondence relationship between a current ratio parameter and a color temperature may be measured, e.g., multiple times, in advance. Specifically, the current flowing through the cool white LED array 14 and the warm white LED array 15 may be collected in advance, and a current ratio parameter may be obtained. Further, a correspondence relationship may be formed between the current ratio parameter and the color temperature of the LED lighting device under the present current. Further, based on the current ratio parameters and the color temperatures corresponding to the present current, a curve reflecting the correspondence relationship between the current ration parameters and the color temperatures may be formed. FIG. 3 illustrates an exemplary curve, reflecting the correspondence relationship between the current ration parameters and the color temperatures. FIG. 3 illustrates the variation of the value of current ratio parameter as a function of the color temperature of the LED lighting device. As shown in FIG. 3, k represents current ratio parameter. The correspondence ratio, e.g., variation of the value of current ratio parameter as a function of the color temperature, may be stored in MCU 12.

Subsequently, when a user desires to change the color temperature, the user may send a target color temperature to the LED lighting device, e.g., through an APP on the mobile phone, through a remote controller, or through other suitable control devices. Based on the target color temperature and the correspondence relationship between the current ratio parameter and color temperature, MCU 12 may obtain the target current ratio parameter corresponding to the target color temperature. MCU 12 may compare the first current ratio parameter with the target current ratio parameter. In some embodiments, when the first current ratio parameter is substantially equal to the ratio of the first current to the second current, and the first current ratio parameter is greater than the target current ratio parameter, MCU 12 may reduce the duty cycle of the first PWM signal and increase the duty cycle of the second PWM signal. The first current ratio parameter being greater than the target current ratio parameter may indicate the current flowing through the cool white LED array 14 is too high, and the duty cycle of the first PWM signal may need to be adjusted to reduce the on-time of the cool white LED array 14. The duty cycle of the second PWM signal may be increased to increase the on-time of the warm white LED array 15. In some other embodiments, when the first current ratio parameter is substantially equal to the ratio of the first current to the second current, and the first current ratio parameter is smaller than the target current ratio parameter, MCU 12 may increase the duty cycle of the first PWM signal and decrease the duty cycle of the second PWM signal. MCU 12 may increase the on-time of the cool white LED array 14 and decrease the on-time of the warm white LED array 15. When the first current ratio parameter is adjusted to be substantially equal to or sufficiently close to the target current ratio parameter, the color temperature of the LED lighting device may be the same as or sufficiently close to the target color temperature.

For an existing LED lighting device, when adjusting the brightness of the LED lighting device, the current ratio parameter of the current flowing through the cool white LED array 14 to the warm white LED array 15 may change accordingly. The variation of the current ratio parameter may cause the color temperature of the LED lighting device to change. For the disclosed LED lighting device, by detecting the current of the cool white LED array 14 and the warm white LED array 15, the first current ratio parameter of the current flowing through the cool white LED array 14 to the current flowing through the warm white LED array 15 may be determined. Based on the correspondence relationship between a current ratio parameter and color temperature obtained in advance, the target current ratio parameter corresponding to the target color temperature may be determined. Further, based on the first current ratio parameter and the target current ratio parameter, the duty cycle of the first PWM signal and the second PWM signal may be adjusted, so that the first current ratio parameter may be substantially equal to the target current ratio parameter. The color temperature of the LED lighting device may stay stable if the first current ratio parameter is unchanged. The disclosed method may ensure the color temperature of the LED lighting device stay unchanged when the brightness of the LED lighting device is being adjusted.

Figure 4:
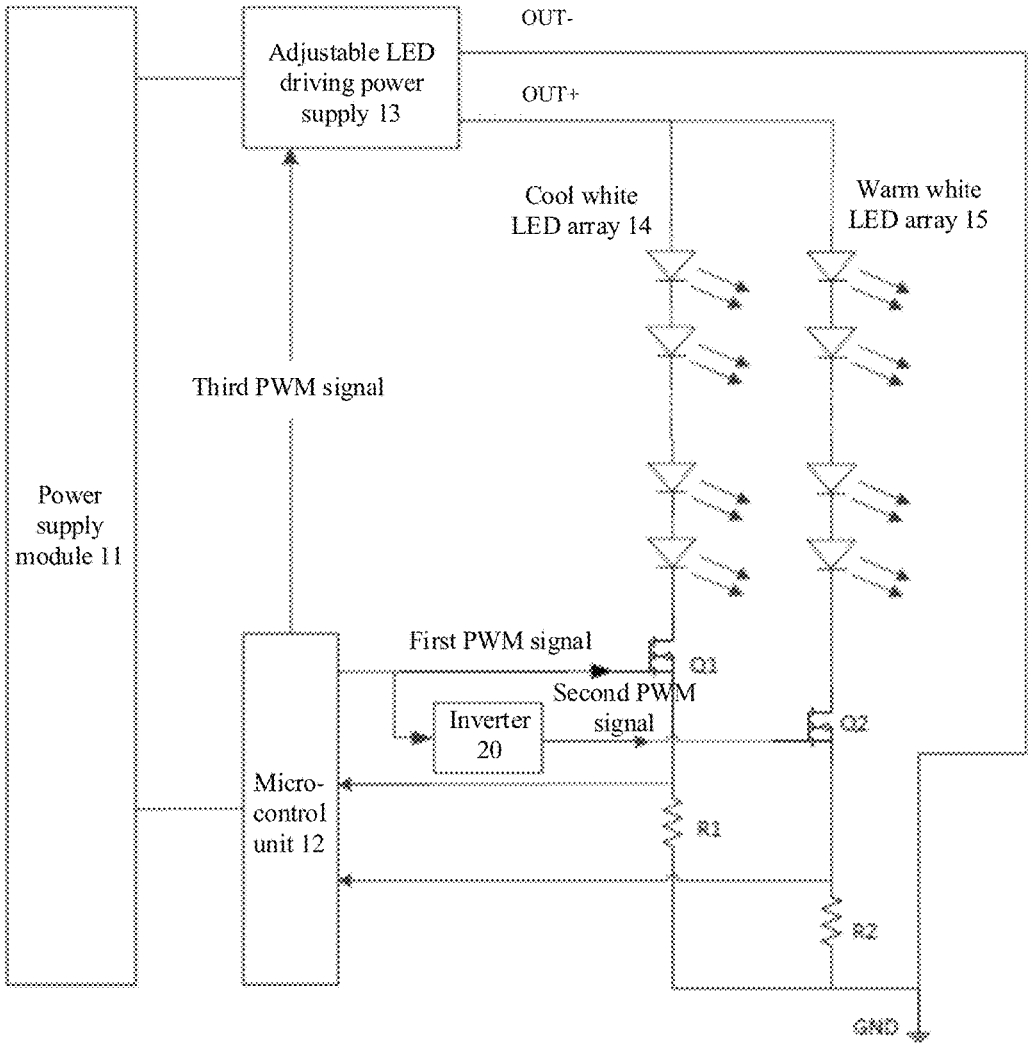
FIG. 4 illustrates a structure of another exemplary color-temperature adjustable LED lighting device consistent with various disclosed embodiments of the present disclosure.

FIG. 4 illustrates another exemplary structure of the disclosed LED lighting device. As shown in FIG. 4, based on the LED lighting device shown in FIG. 2, in one embodiment, the first current detection circuit 18 may be a first resistor R1, the second current detection circuit 19 may be a second resistor R2, the first switch circuit 16 may be a first field effect transistor (FET) Q1, and the second switch circuit 17 may be a second FET Q2.

The first output terminal of the MCU 12 may be connected to the gate electrode of the first FET Q1. The source electrode of the first FET Q1 may be connected to the input terminal of the first current detection circuit 18. The drain electrode of the first FET Q1 may be connected to the cool white LED array 14. The output terminal of the inverter 20 may be connected to the gate electrode of the second FET Q2. The source electrode of the second FET Q2 may be connected to the input terminal of the second current detection circuit 19. The drain electrode of the second FET Q2 may be connected to the warm white LED array 15.

In one embodiment, the first current detection circuit and the second current detection circuit may be implemented using resistors, and the first switch circuit and the second switch circuit may be implemented using FETs. Thus, the disclosed LED lighting device may be easy to implement and may be cheap.

Figure 5:
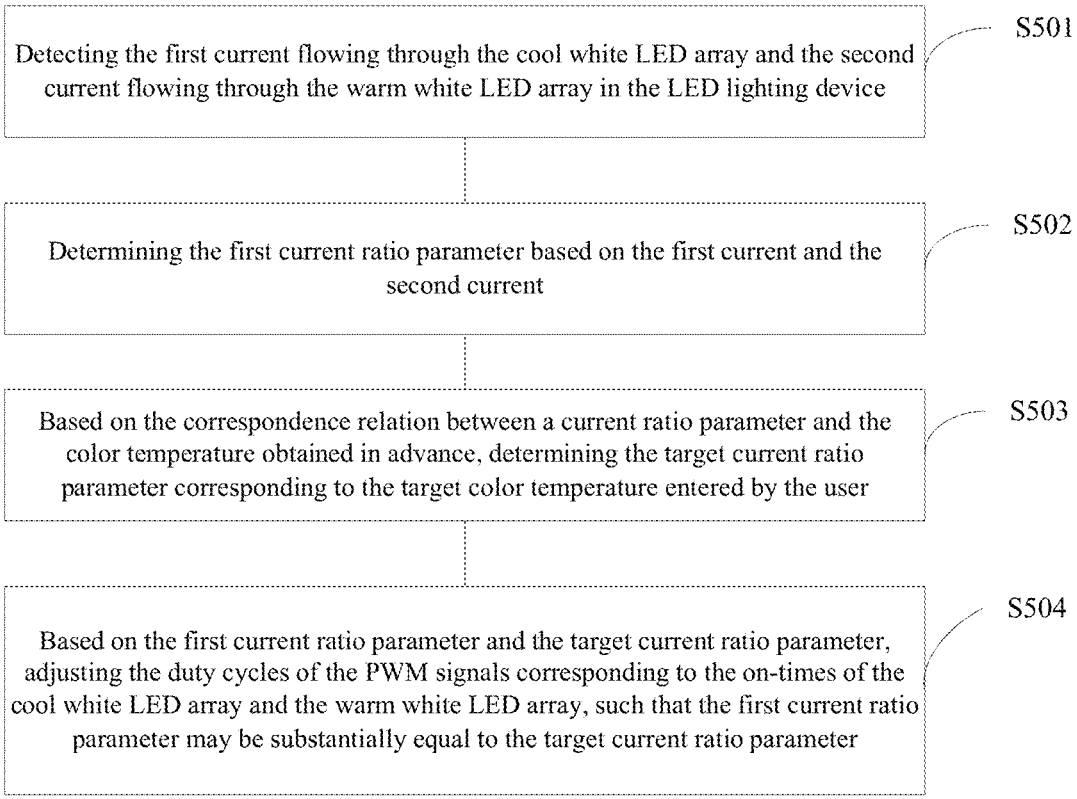
FIG. 5 illustrates an exemplary flow chart of a process for adjusting color temperature of an LED lighting device consistent with various disclosed embodiments of the present disclosure.

Another aspect of the present disclosure further provides a method for adjusting the color temperature of an LED lighting device. FIG. 5 illustrates an exemplary flow chart of a process to adjust the color temperature of an LED lighting device. The method may be used to adjust the color temperature of the LED lighting device disclosed in any one of FIGS. 1,2, and 4. MCU of the LED lighting device may be configured to implement the method. As shown in FIG. 5, the disclosed method may include the following steps S501-S504.

In step S501, the MCU may detect the first current flowing through the cool white LED array and the second current flowing through the warm white LED array in the LED lighting device.

The LED lighting device may include the warm white LED array and the cool white LED array. By arranging the first current detection circuit and the second current detection circuit in the LED lighting device, the MCU may detect the current flowing through the warm white LED array and the cool white LED array through the first current detection circuit and the second current detection circuit, respectively.

In step S502, the MCU may determine the first current ratio parameter based on the first current and the second current.

The first current ratio parameter may be substantially equal to a ratio of the first current to the second current. In some other embodiments, the first current ratio parameter may be a ratio of the first current to the total current, where the total current may be substantially equal to the sum of the first current and the second current. In some other embodiments, the first current ratio parameter may be a ratio of the second current to the total current.

In step S503, based on the correspondence relationship between a current ratio parameter and the color temperature obtained in advance, the MCU may determine the target current ratio parameter corresponding to the target color temperature entered by the user.

In step S504, based on the first current ratio parameter and the target current ratio parameter, the MCU may adjust the duty cycles of the PWM signals corresponding to the on-times of the cool white LED array and the warm white LED array, such that the first current ratio parameter may be substantially equal to the target current ratio parameter. The duty cycle represents the ratio of the on-time to the unit time for a PWM signal.

In one embodiment, the PWM signals used to adjust the ratio of on-times to a unit time for the cool white LED array and the warm white LED array may be the first PWM signal and the second PWM signal described in FIGS. 1, 2, and 4. Details are not repeated herein.

The specific embodiments and technical effect of the disclosed method may be referred to the description of the LED lighting device and are not repeated herein.

It should be noted that, for illustrative purposes, only two LED arrays, i.e., cool white LED array and warm white LED array, are used to describe the present disclosure. In practice, more LED arrays may also be connected to the positive output OUT+ of the adjustable LED driving power supply, similar to the two LED arrays described in the present disclosure, to adjust the color temperature of the LED lighting device. The method to adjust the color temperature may be similar to the disclosed method and is not repeated herein.

Also, the specific way to define the first current ratio parameter may be subjected to different applications and should not be limited by the embodiments of the present disclosure.

According to the disclosed color-temperature adjustable LED lighting device and the method to adjust the color temperature of the disclosed LED lighting device, current flowing through the cool white LED array and the warm white LED array may be detected and used to determine the first current ratio parameter. Based on a correspondence relationship between a current ratio parameter and a color temperature, obtained in advance, the target current ratio parameter corresponding to the target color temperature may be obtained. Further, based on the first current ratio parameter and the target current ratio parameter, the duty cycles of the first PWM signal and the second PWM signal may be adjusted such that the first current ratio parameter may be equal to the target current ratio parameter. When the first current ratio parameter stays unchanged, the color temperature may stay stable/unchanged. Thus, when adjusting the brightness of the disclosed LED lighting device, the color temperature of the disclosed LED lighting device may stay unchanged.

Figure 6:
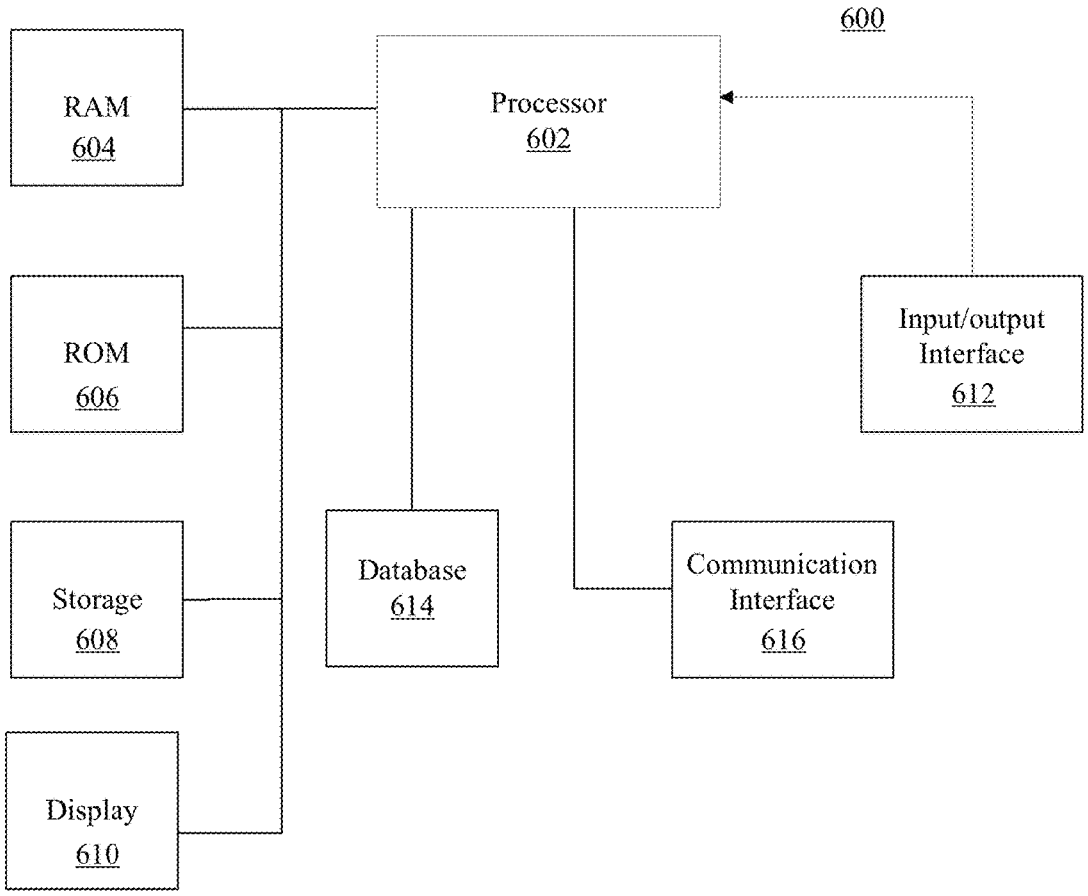
FIG. 6 illustrates a block diagram of a micro-control unit used in various disclosed embodiments of the present disclosure.

FIG. 6 illustrates a block diagram of the MCU 600 used in various embodiments of the present disclosure. The MCU 600 may represent any MCU used in the embodiments of the present disclosure.

The MCU 600 may receive, process, and execute commands from the LED lighting device. The MCU 600 may include any appropriately configured computer system. As shown in FIG. 6, MCU 600 may include a processor 602, a random access memory (RAM) 604, a read-only memory (ROM) 606, a storage 608, a display 610, an input/output interface 612, a database 614; and a communication interface 616. Other components may be added and certain devices may be removed without departing from the principles of the disclosed embodiments.

Processor 602 may include any appropriate type of general purpose microprocessor, digital signal processor or microcontroller, and application specific integrated circuit (ASIC). Processor 602 may execute sequences of computer program instructions to perform various processes associated with MCU 600. Computer program instructions may be loaded into RAM 604 for execution by processor 602 from read-only memory 606, or from storage 608. Storage 608 may include any appropriate type of mass storage provided to store any type of information that processor 602 may need to perform the processes. For example, storage 608 may include one or more hard disk devices, optical disk devices, flash disks, or other storage devices to provide storage space.

Display 610 may provide information to a user or users of the MCU 600. Display 610 may include any appropriate type of computer display device or electronic device display (e.g., CRT or LCD based devices). Input/output interface 612 may be provided for users to input information into MCU 600 or for the users to receive information from MCU 600. For example, input/output interface 612 may include any appropriate input device, such as a keyboard, a mouse, an electronic tablet, voice communication devices, touch screens, or any other optical or wireless input devices. Further, input/output interface 612 may receive from and/or send to other external devices.

Further, database 614 may include any type of commercial or customized database, and may also include analysis tools for analyzing the information in the databases. Database 614 may be used for storing information, e.g., data used for the correspondence relationship between a current ratio parameter and a color temperature. Communication interface 616 may provide communication connections such that MCU 600 may be accessed remotely and/or communicate with other systems through computer networks or other communication networks via various communication protocols, such as transmission control protocol/internet protocol (TCP/IP), hyper text transfer protocol (HTTP), etc.

In one embodiment, input/output interface 612 may receive a user's command, i.e., a target color temperature, to adjust the color temperature of the LED lighting device. A correspondence curve reflecting the correspondence relationship between a current ratio parameter and a color temperature may be stored in the database 614. The input/output interface 612 may send the command to the processor 602. The processor 602 may obtain the first current and the second current through the communication interface 616 or the input/output interface 612, and calculate the first current ratio parameter based on the first current and the second current. The first current ratio parameter may be stored in the ROM 606 and/or the storage 608. The processor 602 may further obtain the target current ratio parameter corresponding to the target color temperature based on the correspondence curve. The processor 602 may perform certain calculations to compare the target current ratio parameter and the first current ratio parameter, and adjust the duty cycles of the first PWM signal and the second PWM signal based on the result of the comparison. The MCU 600 may display the result of the comparison and/or the status of the color-temperature adjustment through the display 610.

For illustrate purposes, terms of "first", "second", "third", and the like are used to merely distinguish different objects, and do not refer to any differences in function nor imply any order.

Modules and units used in the description of the present disclosure may each contain necessary software and/or hardware components, e.g., circuits, to implement desired functions of the modules.

The embodiments disclosed herein are exemplary only. Other applications, advantages, alternations, modifications, or equivalents to the disclosed embodiments are obvious to those skilled in the art and are intended to be encompassed within the scope of the present disclosure.

INDUSTRIAL APPLICABILITY AND ADVANTAGEOUS EFFECTS

Without limiting the scope of any claim and/or the specification, examples of industrial applicability and certain advantageous effects of the disclosed embodiments are listed for illustrative purposes. Various alternations, modifications, or equivalents to the technical solutions of the disclosed embodiments can be obvious to those skilled in the art and can be included in this disclosure.

According to the disclosed color-temperature adjustable LED lighting device and the method to adjust the color temperature of the disclosed LED lighting device, current flowing through the cool white LED array and the warm white LED array may be detected and used to determine the first current ratio parameter. Based on a correspondence relationship between a current ratio parameter and a color temperature, obtained in advance, the target current ratio parameter corresponding to the target color temperature may be obtained. Further, based on the first current ratio parameter and the target current ratio parameter, the duty cycles of the first PWM signal and the second PWM signal may be adjusted such that the first current ratio parameter may be equal to the target current ratio parameter. When the first current ratio parameter stays unchanged, the color temperature may stay stable/unchanged. Thus, when adjusting the brightness of the disclosed LED lighting device, the color temperature of the disclosed LED lighting device may stay unchanged.

REFERENCE SIGN LIST

Power supply module 11
Micro-control unit (MCU) 12/600
Adjustable LED driving power supply 13
Cool white LED array 14
Warm white LED array 15
First switch circuit 16
Second switch circuit 17
First current detection circuit 18
Second current detection circuit 19
Inverter 20
Processor 602
RAM 604
ROM 606
Storage 608
Display 610
Input/output interface 612
Database 614
Communication interface 616

What is claimed is:

1. A color-temperature adjustable light-emitting diode (LED) lighting device, comprising: a power supply module, a micro-control unit (MCU), an adjustable LED driving power supply having a positive output terminal and a negative output terminal, a cool white LED array, a warm white LED array, a first switch circuit, a second switch circuit, a first current detection circuit, a second current detection circuit, and an inverter, wherein:

the power supply module is connected to an input terminal of the MCU and an input terminal of the adjustable LED driving power supply;

a first branch circuit and a second branch circuit are connected in parallel to the positive output terminal of the adjustable LED driving power supply, wherein the cool white LED array, the first switch circuit and the first current detection circuit are connected in series in the first branch circuit, and the warm white LED array, the second switch circuit, and the second current detection circuit are connected in series in the second branch circuit, the negative output terminal of the adjustable LED driving power supply being grounded; and a first terminal of the MCU is connected to the first switch circuit and an input terminal of the inverter, an output terminal of the inverter is connected to the second switch circuit, a second terminal of the MCU is connected to a first terminal of the first current detection circuit, a third terminal of the MCU is connected to a first terminal of the second current detection circuit, a second terminal of the first current detection circuit and a second terminal of the second current detection circuit are both grounded, and a fourth terminal of the MCU is connected to a first terminal of the adjustable LED driving power supply so that the MCU outputs a first pulse width modulation (PWM) signal to the first switch circuit, and the inverter outputs a second PWM signal to the second switch circuit, the second PWM signal and the first PWM signal having inverted phases and being used to control on-times of the warm white LED array and the cool white LED array, respectively.

2. The color-temperature adjustable LED lighting device according to claim 1, wherein:

the MCU detects a first current flowing through the cool white LED array through the first current detection circuit during an on-time of the cool white LED array, detects a second current flowing through the warm white LED array through the second current detection circuit during an on-time of the warm white LED array, and determines a first current ratio parameter based on the first current and the second current;

based on a correspondence relationship between a current ratio parameter, obtained in advance, and a color temperature, the MCU determines a target current ratio parameter corresponding to a target color temperature entered by a user; and based on the first current ratio parameter and the target current ration parameter, the MCU adjusts duty cycles of the first PWM signal and the second PWM signal, such that the first current ratio parameter is substantially equal to the target current ratio parameter.

3. The color-temperature adjustable LED lighting device according to claim 2, wherein:

the MCU detects a first voltage between two terminals of the first current detection circuit, and obtains the first current based on the first voltage and a resistance of the first current detection circuit; and the MCU detects a second voltage between two terminals of the second current detection circuit, and obtains the second current based on the second voltage and a resistance of the second current detection circuit.

4. The color-temperature adjustable LED lighting device according to claim 3, wherein the first current ratio parameter is substantially equal to one of: a ratio of the first current to the second current, a ratio of the first current to a sum of the first current and the second current, and a ratio of the second current to the sum of the first current and the second current.

5. The color-temperature adjustable LED lighting device according to claim 4, wherein the first current ratio parameter is substantially equal to the ratio of the first current to the second current, and if the first current ratio parameter is greater than the target current ratio parameter, the MCU reduces a duty cycle of the first PWM signal and increases a duty cycle of the second PWM signal; and if the first current ratio parameter is smaller than the target current ratio parameter, the MCU increases the duty cycle of the first PWM signal and reduces the duty cycle of the second PWM signal.

6. The color-temperature adjustable LED lighting device according to claim 1, wherein the first current detection circuit is a first resistor, and the second current detection circuit is a second resistor, the first switch circuit is a first field effect transistor (FET), and the second switch circuit is a second FET.

7. The color-temperature adjustable LED lighting device according to claim 6, wherein:

the first terminal of the MCU is connected to a gate electrode of the first FET, a source electrode of the first FET is connected to an input terminal of the first current detection circuit, and a drain electrode of the first FET is connected to the cool white LED array; and the output terminal of the inverter is connected to a gate electrode of the second FET, a source electrode of the second FET is connected to an input terminal of the second current detection circuit, a drain electrode of the second FET is connected to the warm white LED array.

8. A method for adjusting a color temperature of a color-temperature adjustable LED lighting device that includes a micro-control unit (MCU), a cool white LED array, and a warm white LED array, wherein the MCU is configured to generate a first pulse width modulation (PWM) signal and a second PWM signal to control on-times of the cool white LED array and the warm white LED array, respectively, the first and second PWM signals having inverted phases, the method comprising:

detecting a first current flowing through the cool white LED array and a second current flowing through the warm white LED array in the color-temperature adjustable LED lighting device;

determining a first current ratio parameter that is substantially equal to a ratio of the first current to the second current;

based on a correspondence relationship between a current ratio parameter and a color temperature, determining a target current ratio parameter corresponding to a target color temperature entered by a user; and based on the first current ratio parameter and the target current ratio parameter, adjusting duty cycles of the first PWM signal and the second PWM signal that are corresponding to the on-times of the cool white LED array and the warm white LED array, and if the first current ratio parameter is greater than the target current ratio parameter, reducing a duty cycle of the first PWM signal and increasing a duty cycle of the second PWM signal; and if the first current ratio parameter is smaller than the target current ratio parameter, increasing the duty cycle of the first PWM signal and reducing the duty cycle of the second PWM signal.

9. The method according to claim 8, wherein the correspondence relationship between a current ratio parameter and a color temperature is obtained and stored in the color-temperature adjustable LED lighting device before the user enters the target color temperature, the correspondence relationship being formed by measuring correspondence between a current ratio parameter and a color temperature for multiple times.

10. A color-temperature adjustable light-emitting diode (LED) lighting device, comprising:

a cool white LED array and a warm white LED array;

a micro-control unit (MCU) configured to generate a first pulse width modulation (PWM) signal and a second PWM signal, wherein the first and second PWM signals have inverted phases;

a first switch circuit and a second switch circuit that are connected to the MCU and inputted by the first and second PWM signals, respectively, to control on-times of the cool white LED array and the warm white LED array, respectively;

a first current detection circuit connected to the cool white LED array in series and a second current detection circuit connected to the warm white LED array in series, wherein a first current following through the cool white LED array and a second current following through the warm white LED array are detected by the first and second current detection circuits, respectively, and a first current ratio parameter is determined as substantially equal to a ratio of the first current to the second current; and the MCU further determines a target current ratio parameter corresponding to a target color temperature entered by a user based on a corresponding relationship between a current ratio parameter and a color temperature, and if the first current ratio parameter is greater than the target current ratio parameter, the MCU reduces a duty cycle of the first PWM signal and increases a duty cycle of the second PWM signal, and if the first current ratio parameter is smaller than the target current ratio parameter, the MCU increases the duty cycle of the first PWM signal and reduces the duty cycles of the second PWM signal.

* * * * *